US011313149B2

(12) United States Patent
Morrison

(10) Patent No.: US 11,313,149 B2
(45) Date of Patent: Apr. 26, 2022

(54) SYSTEMS, DEVICES, AND/OR METHODS FOR MANAGING DOOR LOCKS

(71) Applicant: Sam Morrison, Lynchburg, VA (US)

(72) Inventor: Sam Morrison, Lynchburg, VA (US)

( * ) Notice: Subject to any disclaimer, the term of this patent is extended or adjusted under 35 U.S.C. 154(b) by 215 days.

(21) Appl. No.: 15/871,848

(22) Filed: Jan. 15, 2018

(65) Prior Publication Data

US 2018/0209171 A1 Jul. 26, 2018

Related U.S. Application Data

(60) Provisional application No. 62/448,441, filed on Jan. 20, 2017.

(51) Int. Cl.

| | |
|---|---|
| ***E05B 13/00*** | (2006.01) |
| ***E05C 19/18*** | (2006.01) |
| ***E05B 67/38*** | (2006.01) |
| ***E05B 17/14*** | (2006.01) |
| *E05B 47/00* | (2006.01) |
| *E05B 35/00* | (2006.01) |

(52) U.S. Cl.

CPC ..... *E05B 13/002* (2013.01); *E05B 17/142* (2013.01); *E05B 67/383* (2013.01); *E05C 19/18* (2013.01); *E05B 35/007* (2013.01); *E05B 47/0043* (2013.01)

(58) Field of Classification Search

CPC ..... E05B 13/00; E05B 13/002; E05B 17/14; E05B 17/142; E05B 17/20; E05B 17/2003; E05B 17/2084; E05B 67/38; E05B 67/383; E05B 1/00; E05B 1/0007; E05B 1/003; E05B 35/007; E05B 47/0043; E05C 17/54; E05C 19/18; G07C 9/20

See application file for complete search history.

(56) References Cited

U.S. PATENT DOCUMENTS

| | | | | | |
|---|---|---|---|---|---|
| 2,080,174 | A * | 5/1937 | Henry | E05B 1/003 | 292/358 |
| 3,475,929 | A * | 11/1969 | Weingart | E05C 19/182 | 292/296 |
| 3,623,346 | A * | 11/1971 | Curtin | E05B 17/142 | 70/424 |
| 3,952,564 | A * | 4/1976 | Maines | E05B 13/001 | 70/416 |
| 4,285,221 | A * | 8/1981 | Atchisson | E05B 13/001 | 70/232 |
| 4,404,826 | A * | 9/1983 | Brill | E05B 13/001 | 70/416 |
| 4,502,720 | A * | 3/1985 | Fayerman | E05B 65/104 | 292/357 |
| 4,728,133 | A * | 3/1988 | Valley | E05B 3/06 | 292/DIG. 60 |
| 5,303,965 | A * | 4/1994 | Meehan | E05B 1/003 | 292/336.3 |

(Continued)

*Primary Examiner* — Christopher J Boswell

(74) *Attorney, Agent, or Firm* — Dale Jensen, PLC; Dale Jensen

(57) ABSTRACT

Certain exemplary embodiments can provide a system, which can comprise a securement. The securement comprises a rising member and defining at least a first slot. The system can comprise a locking member, the locking member defining an aperture. Wherein, when operatively coupled to the securement, a padlock coupled to the locking member via the aperture prevents removal of the locking member from the securement.

12 Claims, 3 Drawing Sheets

(56) References Cited

U.S. PATENT DOCUMENTS

| | | | | | |
|---|---|---|---|---|---|
| 5,425,256 | A * | 6/1995 | Crosby | E05B 13/001 | 292/DIG. 2 |
| 5,560,235 | A * | 10/1996 | Aucoin | E05B 13/001 | 70/163 |
| 5,775,149 | A * | 7/1998 | Small | E05B 13/001 | 109/50 |
| 5,799,521 | A * | 9/1998 | Kennedy | E05B 13/001 | 292/259 R |
| 6,658,906 | B1 * | 12/2003 | Wright | E05B 13/001 | 292/292 |
| 7,077,437 | B2 * | 7/2006 | Hart | E05B 3/06 | 292/DIG. 64 |
| 8,235,431 | B2 * | 8/2012 | Williamson | E05B 1/003 | 292/357 |
| 8,510,994 | B2 * | 8/2013 | Scott | E05B 9/08 | 292/289 |
| 8,534,103 | B2 * | 9/2013 | Brooks | E05B 13/001 | 292/346 |
| 9,003,841 | B2 * | 4/2015 | Koh | E05B 1/003 | 70/216 |
| 9,850,686 | B2 * | 12/2017 | Carlsson | E05B 1/003 | |
| 10,745,935 | B2 * | 8/2020 | Coster | E05B 1/003 | |
| 2021/0238882 | A1 * | 8/2021 | Boyd | E05B 1/003 | |

* cited by examiner

SYSTEMS, DEVICES, AND/OR METHODS FOR MANAGING DOOR LOCKS

CROSS-REFERENCES TO RELATED APPLICATIONS

This application claims priority to, and incorporates by reference herein in its entirety, U.S. Provisional Patent Application Ser. No. 62/448,441, filed Jan. 20, 2017.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Figure 1:
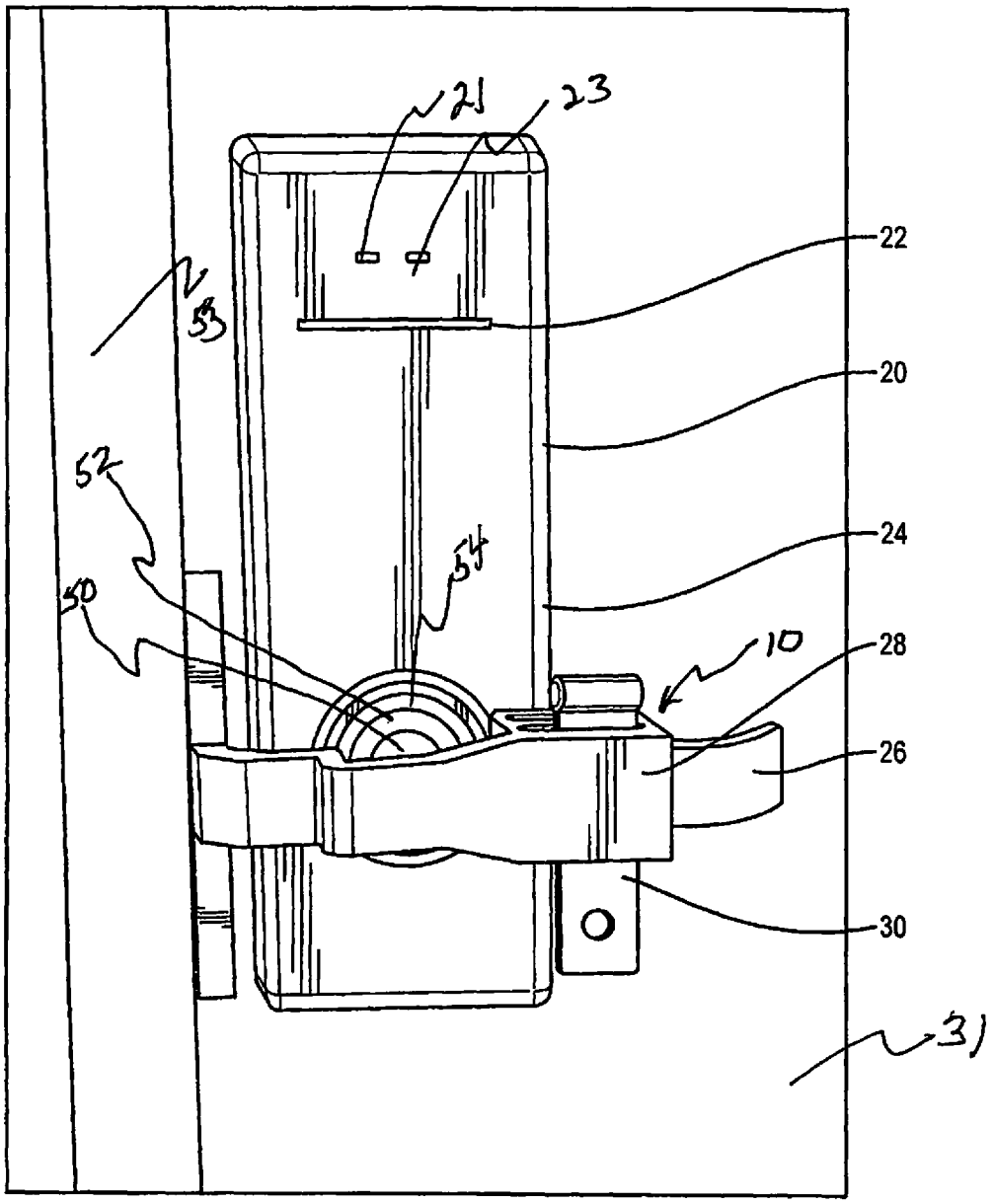
FIG. 1 is an illustration of an exemplary embodiment of a security lock on a key card lock.

Certain exemplary embodiments can provide a system, which can comprise a securement. The securement comprises a rising member and defining at least a first slot. The system can comprise a locking member, the locking member defining an aperture. Wherein, when operatively coupled to the securement, a padlock coupled to the locking member via the aperture prevents removal of the locking member from the securement Certain exemplary embodiments relate to door locks, in particular exemplary card key locks usable on a hotel room door.

Certain exemplary door locks comprise metal boxes that can be unlocked with a key. As doors, locks, and door jams (the structure from which the door is hung so that it may open and close) have improved, the use of a door has extended beyond merely providing access to a dwelling. Internal doors such as those utilized for hotel rooms, motel rooms, public rest rooms, and/or cruise ship rooms often open inwardly toward the space into which the doors provide access. Doors found in residential homes (e.g., doors accessing bathrooms and/or bedrooms, etc.) often have no security or can lock via a pushbutton lockset Hotel, motel, and/or cruise ship doors often have a security lock associated with the doorknob or handle used to open the doors.

These doors can provide additional security comprising a short chain with one end attached to the door and the other end attached to the door jam. While this doesn't keep the door tightly closed, it does permit the occupant to open the door slightly to determine whether the door should be opened fully once the person seeking admittance is viewed. Another device to provide security is a swing bar door guard. This device has a part attached to the door. This part has a hooked arm with a ball at the end. The swing arm is U-shaped such that a hooked arm can fit within the U-shaped swing, but the ball is too large to fit through the spacing in the U-shaped swing arm. The swing arm is bolted to the jam. Thus, the door can be slightly opened similarly to chain devices.

Both chain systems and swing bar door guards can be defeated by an intruder by pushing hard on the door either to break the chain or dislodge system parts from either the door or the jam.

Another option is the use of a dead bolt. While dead bolts offer greater security than either of the other methods, if the person inside the space forgets to engage the dead bolt, as often is the case, they do not function. Further, when the occupants leave the room, they must remove these devices to open the door, thus, there is no security at all to prevent others from entering when the occupants are out of the room.

Certain exemplary door locks permit access via the use of plastic key cards (resembling credit cards as an alternative to a machined metal key) that are coded like a credit card. A number of manufacturers produce such locks. The designs range from the simple rectangular shape as shown in FIG. 1 to a very ornate and highly decorative design.

Such doors often open inwardly by means of a handle on the left or right. In this manner, the hotels, motels, and/or cruise ships can easily "change" the locks each time a new patron uses the room by merely changing the code so that the prior key card will no longer open that door. These key cards are very inexpensive relative to a brass key so if a patron loses his key card or forgets to return it when checking out, this makes the process more efficient and less expensive and this type of lock has gained wide acceptance.

FIG. 1 is an illustration of an exemplary embodiment of a security lock on a key card lock. Lockset 20 can comprises an outside handle 26 and an inside handle (not shown). A key card (not shown) is inserted in a lot 22 in lockset 20 and either green light 21 is illuminated which means the outside handle 26 can be turned and the room entered or red light 23 is illuminated which means outside handle 26 is still locked and cannot be turned and door 31 remains locked. There is also a variation of this lock, which comprises a number pad instead of a card key wherein the user types in a code to open the lock.

Robberies when the occupants are within the room at the time of robbery or with the room empty can occur. This type of crime is more common in resort places such as Las Vegas. Such robberies can be "inside" jobs either by maintenance staff or other employees. While hotels, motels, and/or cruise ships provide safes for guests' valuables, still thefts can occur.

Certain exemplary embodiments provide an easily attachable security lock for inwardly opening doors that cannot be defeated by any unauthorized party whether the occupants of the room are in the room or not. Certain exemplary embodiments provide a security lock for inwardly opening doors that is easily attached by the occupants of the room. Certain exemplary embodiments provide a security lock for inwardly opening doors that can be molded from a plastic that is extremely durable yet inexpensive to produce. Certain exemplary embodiments provide a security lock for inwardly opening doors that can be used with either a right handed handle door lock or a left handed handle door lock.

Certain exemplary embodiments provide a security lock for inwardly opening doors that can be used with most doors using a card key lock. Certain exemplary embodiments provide a security lock for inwardly opening doors that can be taken with the user while traveling to another location. Certain exemplary embodiments provide a security lock for inwardly opening doors that can make it extraordinarily difficult to open the door from the outside without the use of specialized tools.

Certain exemplary embodiments provide a security lock for inwardly opening doors that permits the occupants to exit the room without removal of the security lock. Certain exemplary embodiments provide a security lock for inwardly opening doors that prevents anyone from entering the room even if they have a master card key. Certain exemplary embodiments provide a security lock for inwardly opening doors that is made from a 50/50 blend of 33% glass-filled black nylon 66 and industrial grade straight nylon 66 plastic. Certain exemplary embodiments provide a security lock for inwardly opening doors such that this lock can be attached using a padlock, either key or combination, which can be opened only by the owner of the padlock.

The dimensions of exemplary embodiments can be easily be scaled to accommodate any of type of card key lock having a handle to open the door in accordance with information disclosed herein.

As shown in FIG. 1, securement 10 is used to prevent door 31 from opening from the outside by securing outside handle 26. Note however, even with securement 10 in place, door 31 can always be opened from the inside using the inside handle (not shown) on lockset 20 without removal of securement 10.

Figure 2:
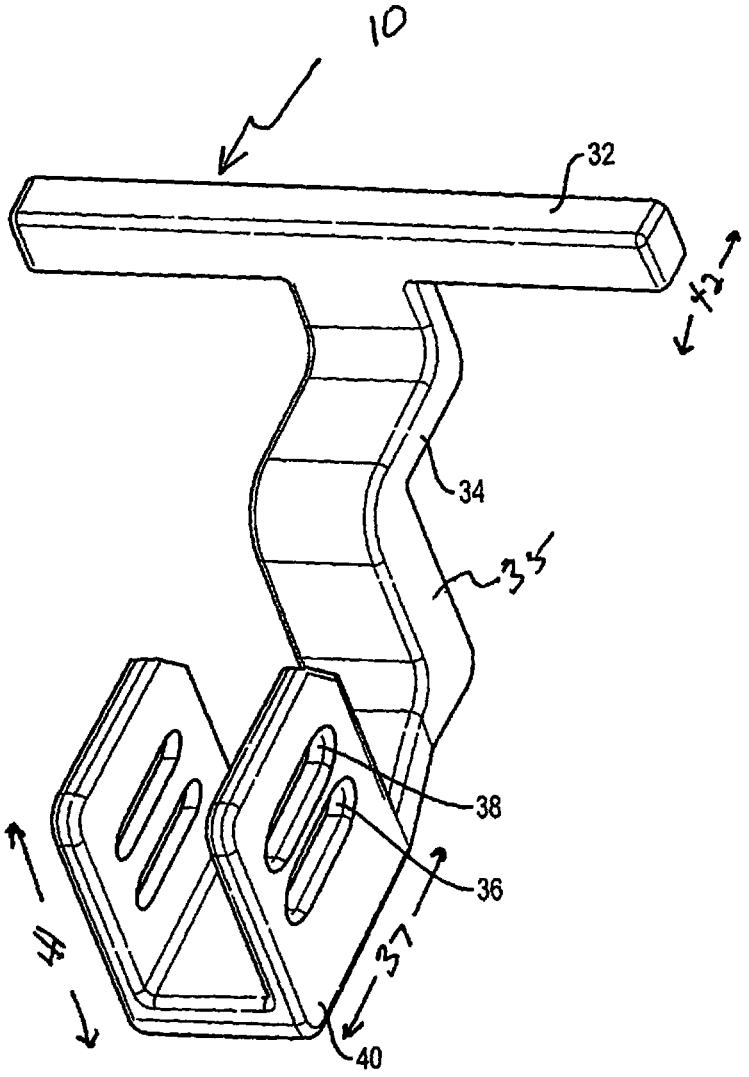
FIG. 2 is an isometric illustration of an exemplary embodiment of a securement.

FIG. 2 is an isometric illustration of an exemplary embodiment of securement 10. Certain exemplary embodiments system components can be molded as single pieces from an extremely strong material such as glass-filled Nylon 66, however, other materials can be suitable as long as that material meets or exceeds a requisite strength.

Locking member 30 has a width 42 that is selected to fit comfortably between door jam 53 and lock housing 24 of lockset 20, which lockset 20 can be opened via a card key when the securement is removed. The tighter the fit of locking member 30, the less outside handle 26 will be able to move. Therefore, a slight movement of outside handle 26 is permissible, since a slight movement will not allow the door 31 to be opened.

A portion of securement 10 defines an S-shape. This enables rising member 34 to clear escutcheon plate 54 and place rising member 34 close to cylinder 52. It is dimensioned to enable securement 10 to clear the thickness of lockset 20 and place securement 10 adjacent to cylinder 52 of lockset 20. This type of lock often has a key cylinder 50 so lockset 20 can be opened in the event of failure of the key card electronics or for service personnel such as maid service.

Dimension 37 of securement 10 is selected so that U-shaped handle locking member 40 can be slipped over outside handle 26. A first slot 36 and/or a second slot 38 are provided so that locking member 30 (shown in FIG. 3) can be inserted therein. To install securement 10, the user merely places securement 10 over outside handle 26 and then inserts locking member 30 into one of first slot 36 and/or second slot 38. To prevent locking member 30 from being removed, a padlock (not illustrated) is placed in aperture 32.

Thus, with security securement 10 in place, outside handle 26 cannot be moved sufficiently to open door 31 from the outside. Since securement 10 covers key lock opening of key cylinder 50, the door 31 cannot be opened by bypassing the card lock feature. However, door 31 can always be opened from inside the room without removal of securement 10.

Securement 10 can generally be installed and/or removed in a few seconds. A user just unlocks a padlock coupled to locking member 30, removes locking member 30, and slips off securement 10 so that the user can take the system with him to his destination.

Figure 3:
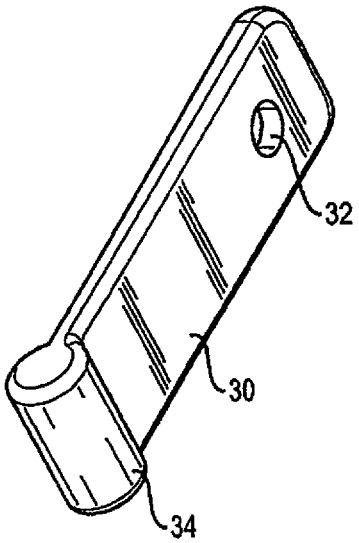
FIG. 3 is an isometric illustration of an exemplary embodiment of a locking member.

FIG. 3 is an isometric illustration of an exemplary embodiment of locking member 30, which prevents securement 10 from being removed without unlocking the padlock. Note Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

- there is no requirement for the inclusion of any particular described or illustrated characteristic, function, activity, or element, any particular sequence of activities, or any particular interrelationship of elements;
- no characteristic, function, activity, or element is "essential";
- any elements can be integrated, segregated, and/or duplicated;
- any activity can be repeated, any activity can be performed by multiple entities, and/or any activity can be performed in multiple jurisdictions; and
- any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A system comprising:

a securement, the securement comprising a rising member and defining a first slot, wherein when operatively installed adjacent to a lockset of a door, the rising member clearing an escutcheon plate of the lockset and placing the rising member close to a cylinder of the lockset such that a key cannot be inserted into a lock opening of the lockset; and a locking member, the locking member constructed to be slidably coupled to the securement through a pair of apertures defined by the securement, each of the pair of apertures substantially surrounding the locking member on four sides, the locking member defining an aperture, wherein, when operatively coupled to the securement, a padlock coupled to the locking member via the aperture prevents removal of the locking member from the securement;

wherein an outside handle of the lockset comprises the cylinder coupled to a non-cylindrical horizontal lever, wherein when the securement and locking member are operatively coupled to the lockset, the lever of the lockset is substantially prevented from fully turning by the securement and the locking member and thereby the door is prevented from being opened until the padlock and locking member are decoupled from the securement.

2. The system of claim 1, wherein:

a portion of the securement defines an S shape.

3. The system of claim 1, wherein:

the door can be opened via an inside handle with the securement in place.

4. The system of claim 1, wherein:

the securement has a width that is selected to fit between a door jam and a lock housing of the lockset.

5. The system of claim 1, wherein:

the securement is constructed to slip over the handle of the lockset.

6. The system of claim 1, wherein:

the securement defines a second slot, the second slot constructed to receive the locking member.

7. The system of claim 1, wherein:

the securement is molded a single piece.

8. The system of claim 1, wherein:

the securement comprises nylon.

9. The system of claim 1, further comprising:

the padlock.

10. The system of claim 1, further comprising:

the lockset.

11. The system of claim 1, further comprising:

the door.

12. A system comprising:

a single piece securement comprising a bar, the bar constructed to fit between a door jamb of a door and a lock housing of a lockset coupled to the door and restrain motion of the securement relative to the lockset when the securement is operatively coupled to the lockset of the door, a portion of the securement adjacent to the bar defining an S-shape, the portion of the securement defining the S-shape enabling a rising member of the securement to clear an escutcheon plate of the lockset and place the rising member close to a cylinder of the lockset, the securement comprising a U-shaped handle locking member adjacent to the portion of the securement defining the S-shape, the U-shaped handle locking member defining a plurality of apertures on each leg of the U-shaped handle locking member, the U-shaped handle locking member sized to slip over a non-cylindrical handle of the lockset; and a locking member, the locking member constructed to be slidably coupled to the U-shaped handle locking member through two of the plurality of apertures, each of the two of the plurality of apertures substantially surrounding the locking member on four sides, the locking member defining an aperture, wherein, when operatively coupled to the securement, a padlock coupled to the locking member via the aperture prevents removal of the locking member from the securement, wherein when the securement and locking member are operatively coupled to the lockset:

a key cannot be inserted into a lock opening of the lockset; and the lever of the lockset is substantially prevented from fully turning by the securement and the locking member and thereby the door is prevented from being opened until the padlock and locking member are decoupled from the securement.

* * * * *